US007588205B2

(12) United States Patent
Ishikawa et al.

(10) Patent No.: US 7,588,205 B2
(45) Date of Patent: Sep. 15, 2009

(54) MEDIUM AGITATION MILL

(75) Inventors: Tsuyoshi Ishikawa, Narashino (JP); Jiro Onuki, Narashino (JP); Yasuhiro Mitsuhashi, Narashino (JP); Kaori Harigai, Narashino (JP)

(73) Assignee: Ashizawa Finetech Ltd., Chiba-ken (JP)

( * ) Notice: Subject to any disclaimer, the term of this patent is extended or adjusted under 35 U.S.C. 154(b) by 153 days.

(21) Appl. No.: 11/986,543

(22) Filed: Nov. 23, 2007

(65) Prior Publication Data

US 2008/0245910 A1 Oct. 9, 2008

(30) Foreign Application Priority Data

Apr. 6, 2007 (JP) ..... 2007-099964

(51) Int. Cl.
*B02C 17/16* (2006.01)

(52) U.S. Cl. ..... 241/171; 241/172

(58) Field of Classification Search ..... 241/171, 241/172

See application file for complete search history.

(56) References Cited

U.S. PATENT DOCUMENTS 5,346,145 A * 9/1994 Kamiwano et al. ..... 241/172
5,566,896 A * 10/1996 Stehr et al. ..... 241/171
5,791,569 A * 8/1998 Ishikawa ..... 241/74
7,374,116 B2 * 5/2008 Ishikawa et al. ..... 241/171

FOREIGN PATENT DOCUMENTS

JP 2002-306940 10/2002
WO WO96/39251 12/1996 ..... 13/286

OTHER PUBLICATIONS

"Official Journal of the Particle Technology Society", vol. 41, No. 8 (Serial No. 423), pp. 16-23, published Aug. 10, 2004.
"Collection of Lectures Given at the 40th Summer Symposium by the Particle Technology Society", Jul. 29 and 30, 2004, pp. 13 and 14, Lecture 5, "Dispersion of an Aggregation of Nano-Particles in a Bead Mill Using Ultrafine Beads".

* cited by examiner

*Primary Examiner*—Mark Rosenbaum
(74) *Attorney, Agent, or Firm*—Renner, Kenner, Greive, Bobak, Taylor & Weber

(57) ABSTRACT

The object of the present invention is to provide a medium agitation mill which is responsive to the standstill of the mill for preventing the pulverizing medium from invading the inside space of the longitudinal hollow space of the drive shaft of the impeller.

In the medium agitation mill the medium separating impeller is arranged in the inside space of the agitating member, and the impeller has a plurality of vanes circumferentially arranged at intervals, and is driven by the hollow drive shaft, one end of which opens to the inside of the impeller to provide the raw material discharging port. The discharging port is provided with an on-off valve of a resilient material to open and close the discharging port.

15 Claims, 8 Drawing Sheets

MEDIUM AGITATION MILL

FIELD OF THE INVENTION

The present invention relates to a medium agitation mill comprising a pulverizing cylindrical tank equipped with an agitating member, the cylindrical tank containing a medium for use in crushing or grinding a substance to be pulverized. In operation the agitating member is rotated while the tank is supplied with a raw material bearing a "to be pulverized" substance all the time, thus crushing or grinding the substance into very fine particles through the agency of the pulverizing medium. A medium agitation mill is appropriate for use in dispersing or pulverizing ink, pigment, ceramics, dyestuff, metal, inorganic substance, ferrite, toner or glass, although use of the medium agitation mill is not limited to these substances.

Such medium agitation mills have been widely used in crushing or grinding a raw material in the form of relatively large-sized particles into very fine particles or in dispersing the pulverized substance in a liquid. Such mills are equipped with a separator on the outlet side to separate the pulverized substance from the pulverizing medium. Generally speaking, the separator is a screen or is provided in the form of the slit between a stationary part and an associated rotary part.

It, however, has been realized that such screen or slit type separator has many defects in the field of nano-technology, in which there has been an ever increasing demand for dealing with problems pertaining to ultrafine particles these years. Specifically to meet the demand for providing ultrafine particles as required in the field of nano-technology it is required that particles of the pulverizing medium be reduced in size, compared with the conventional medium particle size. Assuming that conventional separators use a very small-sized particle medium, they are likely to be clogged with the medium sooner or later, and their parts are easy to badly wear away. Therefore, such separators need frequent maintenance and repair. At present the medium particle size is said to be limited to 0.2 mm.

Some remedies for the problem discussed above have been proposed in:

Patent Document 1: Patent Application Laid-Open No. 2002-306940;

Patent Document 2: International Publication WO96/39251;

Non-Patent Document 1: the "Official Journal of the Particle Technology Society", Vol.41, No.8 (Serial No. 423), page 16 to page 23, published on Aug. 10, 2004;

and Non-Patent Document 2: the "Collection of Lectures Given at the 40$^{th}$ Summer Symposium by the Particle Technology Society", Jul. 29 and 30, 2004, pages 13 and 14, Lecture 5, "Dispersion of an Aggregation of Nano-Particles in a Bead Mill Using Ultrafine Beads".

Non-Patent Documents 1 and 2 disclose a medium agitation mill which is so designed that the "to be crushed" particle suspended slurry is separated from the pulverizing medium under the centrifugal influence, thereby permitting use of the pulverizing bead medium whose bead size is as small as 0.03 mm. In these documents it is reported that undesired agglomeration of crushed and dispersed ultrafine particles is effectively prevented by limiting the rotation speed of the agitating member to a certain range, thereby attaining reduction of particle size as desired. Specifically for the 0.03 mm-large bead medium used the circumferential speed of the rotor or agitating member is limited to 10 m/sec for the best result.

Patent Document 2 is an international patent application corresponding to the Non-Patent Documents 1 and 2, disclosing a wet agitating ball mill whose agitating shaft has an impeller fixed thereto on the discharging side. The impeller comprises a pair of disks fixed to the agitating shaft and a plurality of blades fixed between the opposite disks, and the inter-disk space communicates with the hollow space of the agitating shaft to provide a slurry discharging port.

In the mills described in Non-Patent Documents 1 and 2 or Patent Document 2 a separator, which comprises a pair of disks with blades fixed therebetween, is rotated by rotating the agitating shaft so that the particle medium of a relatively large specific gravity are driven outward in radial directions under the centrifugal influence, leaving the slurry of a relatively small specific gravity behind. Thanks to the centrifugal action, the pulverizing medium whose bead size is as small as 0.03 mm can be used without the fear of the separator being clogged.

The mills described in these documents have their agitating members and separators arranged in line with the shaft on the slurry discharging side, and therefore, disadvantageously the compacting of the pulverizing particle medium in the vicinity of the slurry discharging port in the crushing tank cannot be avoided. Clogging-free operation may be experimentally realized in laboratories, but the continuous, long-term running in industries will most probably cause the separator to be clogged with the pulverizing medium.

In the medium agitation mill as disclosed in Patent Document 1 a cylindrical rotor is rotatably arranged in the cylindrical tank with an annular gap left therebetween. A channel extends in the inside of the cylindrical rotor to the discharging port, and the channel communicates with the annular gap, also. A centrifugal separator is arranged in the channel to separate the pulverizing particle medium from the slurry and driving the so separated medium to the annular gap through the openings of the circumference of the cylindrical rotor for circulation. The centrifugal separator is driven by a rotary shaft, which is telescoped in the rotor shaft. The centrifugal separator comprises a vane wheel or impeller having a plurality of vanes fixed to its rotary shaft, and the slurry-and-medium mixture follows the center axle of the impeller, and then, the particle medium having a relatively large specific gravity is made to fly outward in radial directions, leaving the slurry having a relatively small specific gravity behind. Thus, a required separation results. This document gives some examples using a 0.1 mm-large particle medium.

In the mill disclosed in Patent Document 1 the slurry-and-medium mixture is directed to the center portion of the impeller, thus allowing the particle medium to hit the vanes, and the vanes throw the particle medium away in radial directions. The vanes, therefore, will be worn at an early stage. Still disadvantageously, the slurry-and-medium mixture undergoes turbulence in the separator, and therefore, a required separation cannot be attained in respect of the particle size, and the slurry carries relatively wide-range distributed particles.

In Patent Application Laid-Open No. 2006-212488 the Applicant proposed an improved medium agitation mill designed for using a pulverizing medium of very small-sized beads, ensuring not only the positive separation of ultrafine particles from the pulverizing medium but also the pulverization into ultrafine particles of rated granularity, thus providing a finely pulverized material whose grains are distributed in a relatively narrow range of granularity, and still advantageously the medium agitation mill is almost free of being worn in operation.

In the so proposed medium agitation mill an agitating member is rotatably fixed in a cylindrical pulverizing tank with an inlet provided for a raw material bearing a substance to be pulverized, and the pulverizing tank has a pulverizing compartment with a pulverizing media contained therein. By rotating the agitating member while being supplied with the raw material via the inlet the pulverizing medium is agitated to crush or grind the substance into ultrafine particles. The agitating member comprises a hollow, bottomless cylinder having a cylindrical wall on its circumference, the cylindrical wall having apertures circumferentially made at intervals for circulating the pulverizing medium. The agitating member has a medium-separating vane wheel arranged coaxial with the agitating member and rotatably fixed in its inner space and, the medium-separating vane wheel has a plurality of vanes arranged on its circumference and fixed at intervals to move the pulverizing medium of a relatively large specific gravity outward in radial directions under the centrifugal influence caused by the rotating impeller. The impeller has a hollow drive shaft at its center, and the hollow drive shaft opens to the inside of the impeller, thereby allowing the discharging of the raw material bearing finely pulverized particles to the exterior. Preferably the vanes are sandwiched between confronting ceiling and floor circular plates, and the hollow drive shaft is fixed to the ceiling plate to open to the space defined between the ceiling plate and floor plate, thus providing an outlet for the raw material.

The medium agitation mill has a great advantage of effectively separating ultrafine particles from the pulverizing medium of small-sized beads through the agency of the medium separating impeller, but when the mill stops to lose the centrifugal force, the pulverizing medium in the vicinity of the discharging port invades the inside of the hollow drive shaft, remaining there. The remaining pulverizing medium is discharged along with the ultrafine particles when the mill starts running again.

SUMMARY OF THE INVENTION

In view of the above one object of the present invention is to provide a medium agitation mill capable of preventing the pulverizing medium from invading the inside of the hollow drive shaft of the impeller subsequent to the standstill of the mill's running.

To attain this object a medium agitation mill according to the present invention is constructed as described in following Paragraphs 1 to 7:

1. A medium agitation mill in which an agitating member is rotatably fixed in a cylindrical pulverizing tank with an inlet provided for a raw material bearing a substance to be pulverized, the pulverizing tank having a pulverizing compartment with a pulverizing medium contained therein, thus rotating the agitating member while being supplied with the raw material via the inlet and agitating the pulverizing medium to crush or grind the substance into ultrafine particles, characterized in that:

the agitating member comprises a hollow, bottomless cylinder having a cylindrical wall on its circumference, the cylindrical wall having apertures circumferentially made at intervals for circulating the pulverizing medium;

the agitating member has a media-separating vane wheel arranged coaxial with the agitating member and fixed in its inner space and, the media-separating vane wheel having a plurality of vanes arranged on its circumference and fixed at intervals; and a hollow drive shaft has an outlet at its end, opening to the inside of the media-separating vane wheel, and is adapted to drive and rotate the vane wheel so as to make the relatively heavy medium fly away from the relatively light "to be pulverized" substance in radial directions under the centrifugal influence, allowing the crushed substance separate from the medium to flow into the outlet, which has an on-off valve responsive to the standstill of the vane wheel for closing the outlet and responsive to the rotating of the vane wheel for opening the outlet under the centrifugal influence.

2. A medium agitation mill according to claim 1 wherein the on-off valve is of a resilient material of elastomer.

3. A medium agitation mill according to claim 1 wherein the on-off valve is of a resilient material of metal.

4. A medium agitation mill according to any of claims 1 to 3 wherein the plurality of vanes of the media-separating vane wheel are fixed to an end plate, which confronts the outlet of the hollow drive shaft for the raw material, the hollow drive shaft having a conical closure fixed to its end with the flat base of the conical closure resting on the raw material outlet, the conical closure having an outlet passage formed and opening at one end on the bottom of the conical closure whereas opening at the other end on the slope surface of the conical closure to communicate with the longitudinal hollow space of the drive shaft, thus permitting the pulverized material separate from the medium to follow the outlet passage and the longitudinal hollow space to the exterior, the on-off valve being a skirt-like object hanging from the end plate of the vane wheel with its leading end put in contact with the slope surface of the conical closure in such a position the leading end is away from the entrance of the outlet passage and close to the periphery of the conical closure while the vane wheel stays at rest, thus making the skirt responsive to the rotation of the vane wheel for opening wide apart from the slope surface of the conical closure and opening the entrance of the outlet passage.

5. A medium agitation mill according to any of claims 1 to 3 wherein the hollow drive shaft has a conical closure fixed to its end with the flat base of the conical closure resting on the raw material outlet of the drive shaft, the conical closure having an outlet passage formed therein and opening at one end on the bottom of the conical closure whereas opening at the other end on the slope surface of the conical closure to communicate with the longitudinal hollow space of the drive shaft, thus permitting the pulverized material separate from the medium to follow the outlet passage and the longitudinal hollow space to the exterior, the on-off valve being a plate traversing the entrance of the outlet passage, the plate being pivotally fixed by the upper end, thereby permitting its free end to rotate about the pivot between the closing position to close the entrance of the outlet passage and the opening position to open the entrance of the outlet passage while the plate is raised apart from the slope surface of the conical closure.

6. A medium agitation mill according to any of claims 1 to 3 wherein the hollow drive shaft has a cylindrical closure fixed to its end with the bottom of the cylindrical closure confronting the end of the outlet channel of the drive shaft, the cylindrical closure having at least one outlet passage formed in its side and opening to the hollow space of the cylindrical closure, thus forming a hollow extension connecting to the longitudinal hollow space of the drive shaft and permitting the pulverized material separate from the medium to follow the hollow extension of the cylindrical closure and the longitudinal hollow space of the drive shaft to the exterior, the on-off valve comprising a valve seat formed in the hollow extension, a valve body movable between the closing position where the valve body rests on the valve seat and the opening position where the valve body leaves the valve seat, and a resilient member to push the valve body against the valve seat while the vane wheel stops and yieldingly deform and allow the valve body to shift to the opening position under the centrifugal influence while the vane wheel rotates.

7. A medium agitation mill according to any of claims 1 to 3 wherein the hollow drive shaft has a cylindrical closure fixed to its end with the bottom of the cylindrical closure confronting the end of the outlet channel of the drive shaft, the cylindrical closure having an outlet passage formed in its bottom and opening to the hollow space of the cylindrical closure, thus forming a hollow extension connecting to the longitudinal hollow space of the drive shaft and permitting the pulverized material separate from the medium to follow the hollow extension of the cylindrical closure and the longitudinal hollow space of the drive shaft to the exterior; the on-off valve comprising a valve seat formed in the hollow extension, a valve body movable between the closing position where the valve body rests on the valve seat and the opening position where the valve body leaves the valve seat, and a resilient member to push the valve body against the valve seat into the closing position while the vane wheel stops and yieldingly withdraw and permit the valve body to move to the opening position under the increased pressure from the raw material while the vane wheel rotates.

When the medium agitation mill as described above stops in operation, the on-off valve of a resilient material is released from the centrifugal restrain, and then, the on-off valve resiliently returns to the closing position where it closes the outlet for the raw material, thereby effectively preventing the pulverizing medium from invading the inside of the hollow drive shaft.

BRIEF DESCRIPTION OF THE DRAWINGS

The present invention will now be described in detail with reference to the accompanying drawings, in which.

PREFERRED EMBODIMENTS

Figure 1:
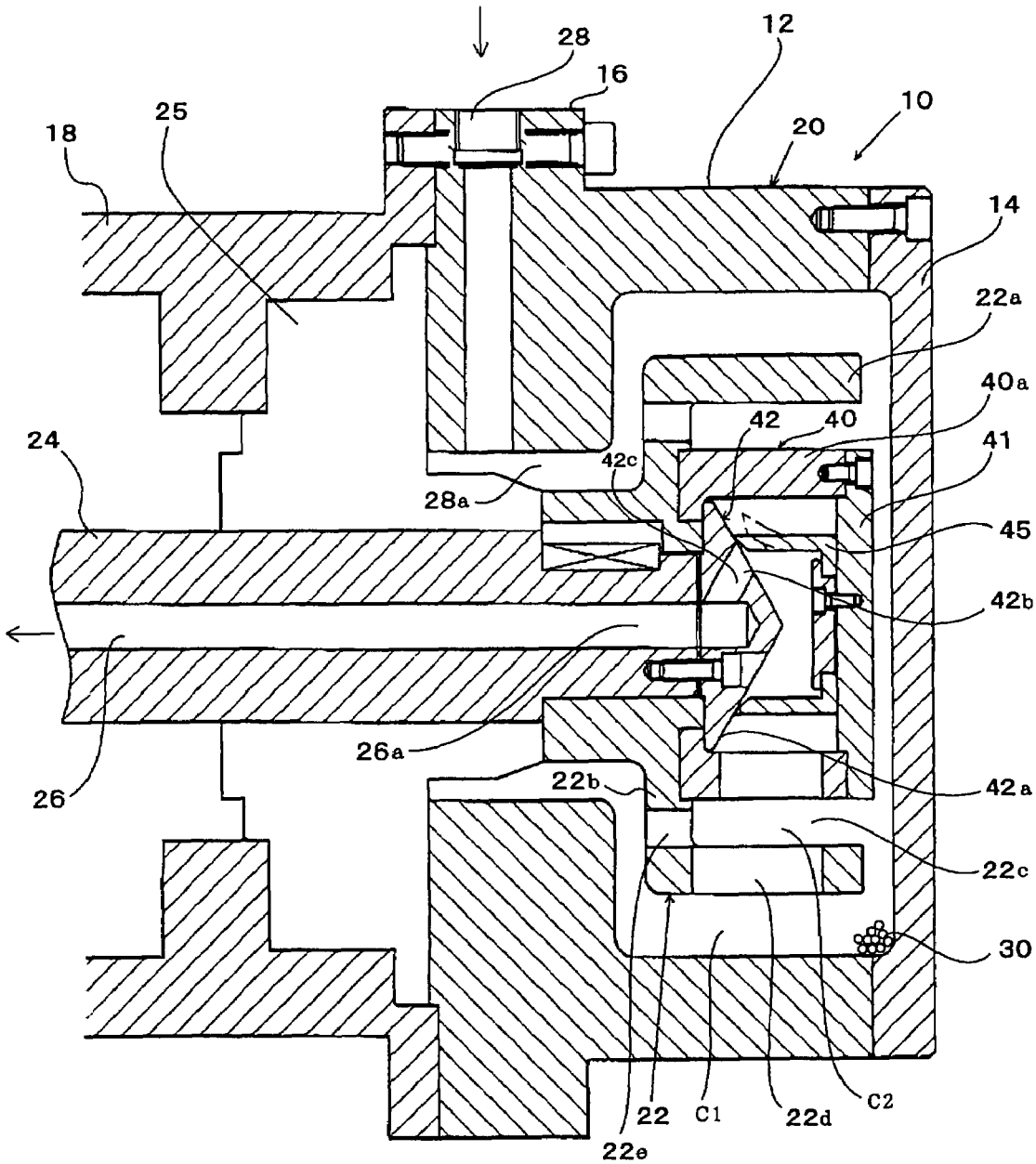
FIG. 1 is a longitudinal section of a medium agitation mill according to one embodiment of the present invention.

Referring to FIG. 1, a medium agitation mill 10 according to one embodiment of the present invention includes a pulverizing tank 20 comprising a cylindrical barrel 12, one end plate 14 fixed to one end of the barrel 12 and a frame structure 18 fixed to the other end of the barrel 12 via a raw material inlet flange 16.

An agitating member 22 is rotatably arranged in the pulverizing tank 20. The agitating member 22 is a hollow cylinder having a circular wall 22*a* on its circumference and a hub 22*b* to close one end of the circular wall 22*a*, opening at the other end to define an opening 22*c*. A hollow rotary drive shaft 24 is fixed to the center of the hub 22*b* of the agitating member 22. The rotary drive shaft 24 extends in the axial direction in the frame structure 18, and is connected by the distal end to a driving power source via an associated drive mechanism well known per se (not shown) for rotation. The rotary drive shaft 24 passes through a mechanical seal 25, which helps the agitating member 22 and the pulverizing tank 20 define a pulverizing compartment C1 between the cylindrical wall 22*a* of the agitating member 22 and the inner circumferential wall surface of the pulverizing tank 20. The flange 16 has a raw material inlet 28 through which a raw material in the state of being slurry can enter the mill 10. Preferably a raw material feeding passage 28*a* is formed on the rear side of the hub 22*b* to connect the raw material inlet 28 to the pulverizing compartment C1. As is well known, the pulverizing medium 30 in the form of beads is put in the pulverizing compartment C1.

A centrifugal type of medium separating vane wheel or impeller 40 is arranged coaxial with the circular wall 22*a* of the agitating member 22 to separate the medium beads 30 from the slurry raw material. The annular space between the medium separating impeller 40 and the inner cylindrical wall surface 22*a* is called "medium separating compartment" C2. The longitudinal hollow space of the rotary drive shaft 24 communicates with the inside of the medium separating impeller 40 to provide a raw material discharging channel 26*a*, allowing the pulverized slurry raw material to follow the discharging channel 26*a* to the exterior.

Figure 2:
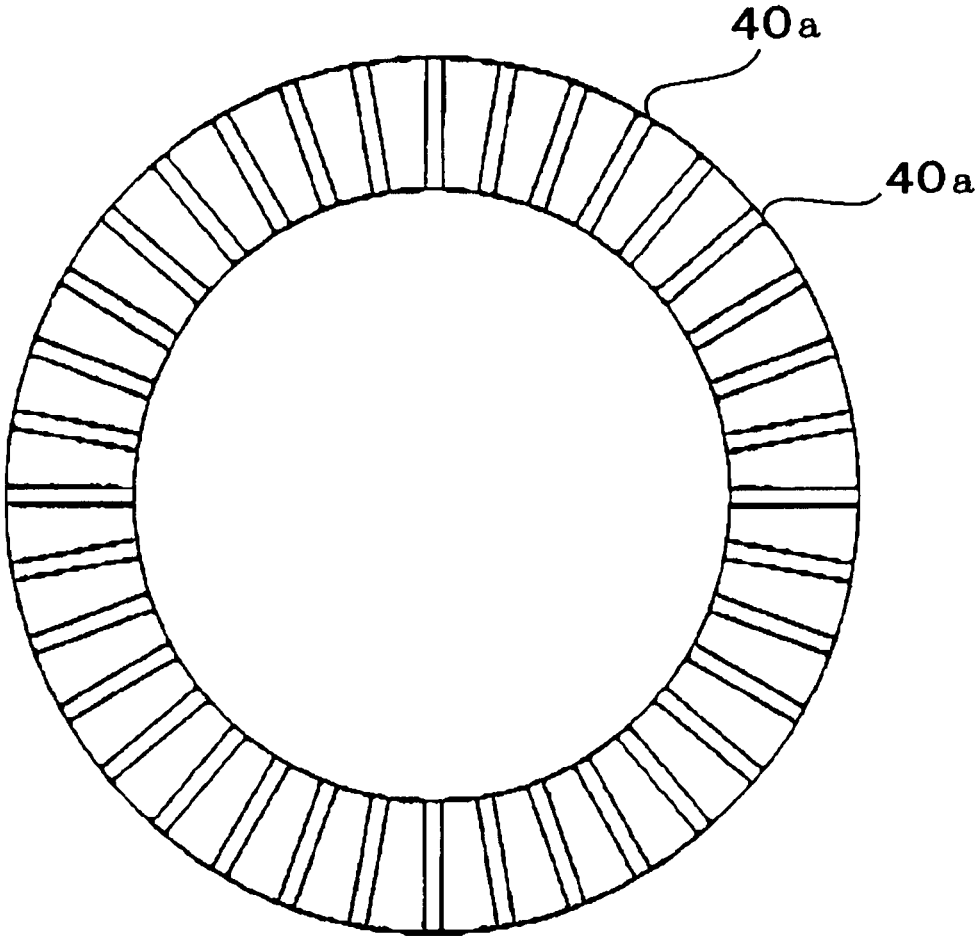
FIG. 2 is a cross section of one example of the medium separating vane wheel used in the medium agitation mill of FIG. 1.
Figure 3:
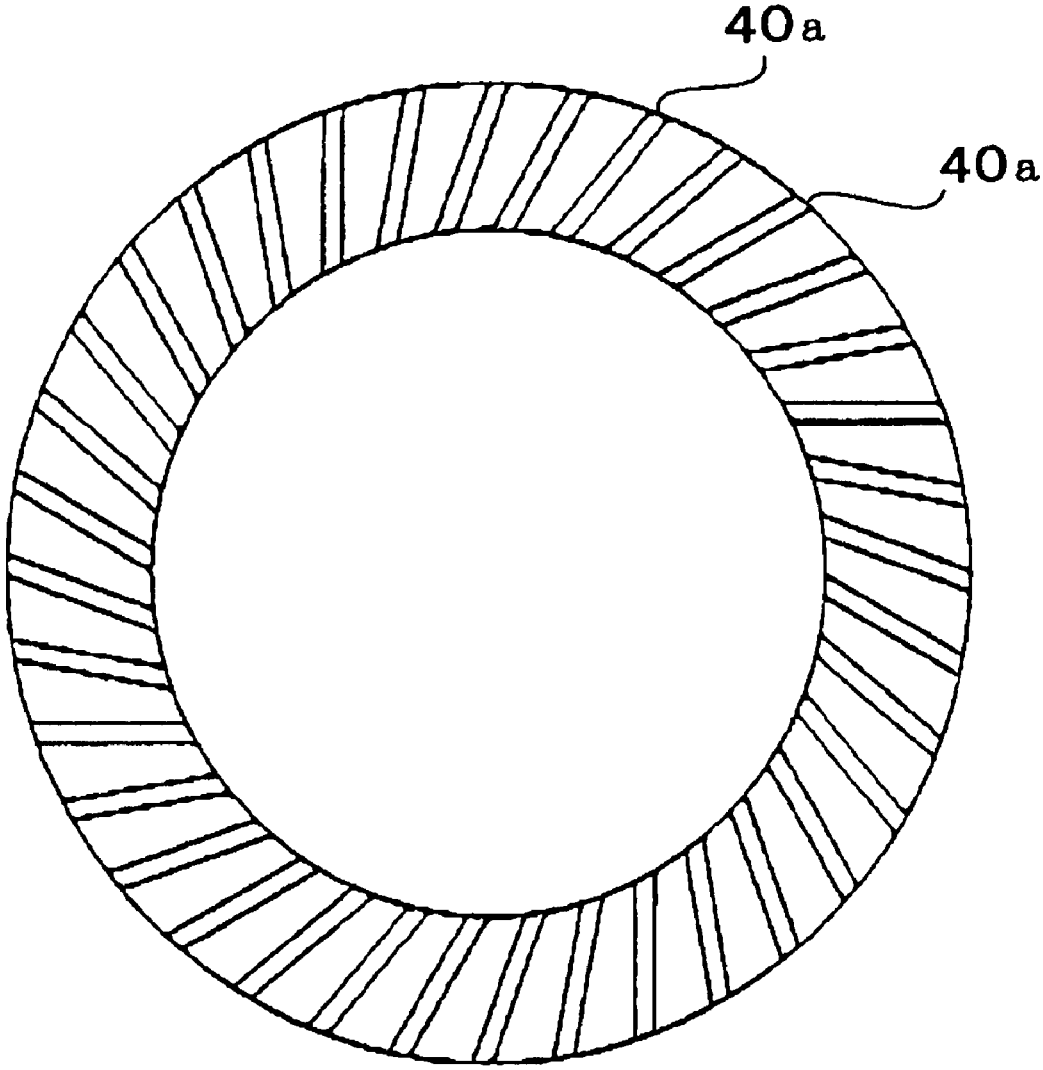
FIG. 3 is a cross section of another example of the medium separating vane wheel.

The medium separating vane wheel 40 has an end plate 41 confronting the hub 22*b* of the agitating member 22, and a plurality of vanes 40 are circumferentially arranged at regular intervals between the end plate 41 and the hub 22*b*. As seen from FIG. 2, the vanes 40*a* may be arranged in radial directions. Otherwise, as seen from FIG. 3, the vanes 40*a* may be arranged obliquely in radial directions.

The raw material discharging channel 26 may be arranged on the side of the end plate 14. Specifically the end plate 14 has a circular aperture made at its center, and a conduit is fixed to the end plate 14 to provide a stationary raw material discharging channel. Such conduit is preferably arranged coaxial with the rotary drive shaft 24, one end (inner end) of the conduit is positioned in the inside of the medium separating impeller 40 passing through the circular aperture of the end plate 14, thus allowing the pulverized slurry raw material to flow into the conduit.

Figure 4:
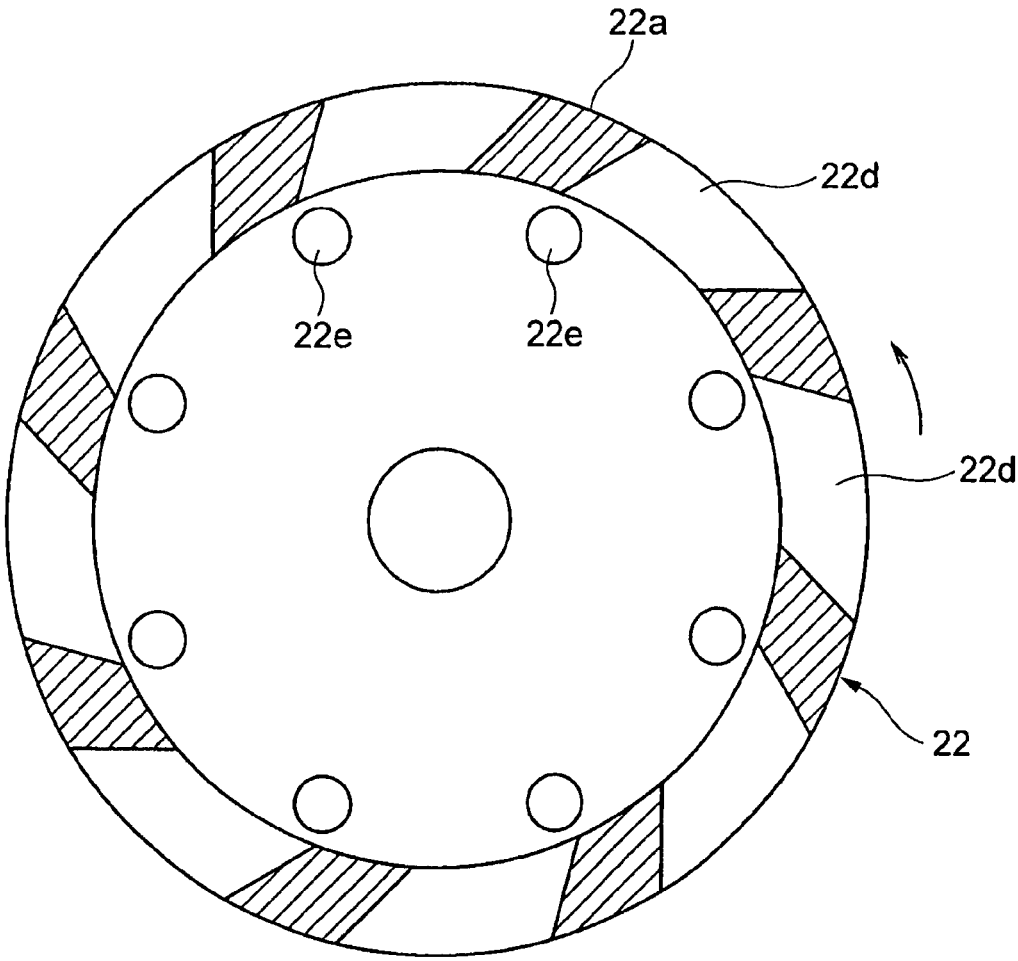
FIG. 4 is a cross section of one example of an agitating member used in the medium agitation mill of FIG. 1.

As shown in FIG. 4, the circular wall 22*a* of the agitating member 22 has a plurality of openings 22*d* circumferentially made at regular intervals for circulating the pulverizing medium. Preferably these openings are directed oblique as shown in FIG. 4. Likewise, the hub 22*b* of the agitating member 22 has a plurality of openings 22*e* circumferentially made at regular intervals for circulating the pulverizing medium. The medium separating compartment C2 communicates with the pulverizing compartment C1 through these openings 22*d* and 22*e*, thus allowing the pulverizing medium 30 to freely move outward from the inside of the agitating member 22. Thus, the degree of mobility of the pulverizing medium 30 is raised, and accordingly the pulverizing efficiency is improved.

In the medium agitation mill 10 a conical discharging member or conical closure 42 is fixed to the inner end of the rotary drive shaft 24, from which inner end the raw material discharging channel 26*a* runs downstream. The conical discharging member 42 is fixedly set on the discharging end with its flat base resting on the raw material outlet 26. The conical closure has an outlet passage 42*c* formed and opening at one end on the bottom of the conical closure and opening at the other end on the slope surface 42*a* of the conical closure to define an outlet passage or discharging exit 42*b*, thus permitting the pulverized slurry raw material separate from the pulverizing medium to follow the outlet passage 42*c* and the raw material discharging channel 26 of the rotary drive shaft 24 to the exterior. Here, it should be noted that: the discharging member or conical closure 42 makes up one part of the rotary drive shaft 24; the outlet passage 42*c* makes up one part of the raw material discharging channel 26; and the discharging exit 42*b* is exactly the entrance of the raw material discharging channel 26. This is the same with other embodiments described later.

The medium agitation mill uses an on-off valve 45 of a resilient material to open and close the raw material discharging exit 42*b*. Specifically the on-off valve 45 is responsive to the standstill of the medium separating impeller 40 for closing the discharging exit 42*b*, and responsive to the rotation of the impeller 40 for opening the discharging exit 42*b* as the resilient force is being overcome by the centrifugal force. When the impeller 40 stops, the centrifugal force disappears, allowing the on-off valve to return to the closing position automatically under the resilient influence. In this particular embodiment such on-off valve 45 is a skirt-like object hanging from the end plate 41 of the impeller with its leading edge 45*a* put in contact with the slope surface 42*a* of the conical closure 42 in such a position that the leading edge 45*a* is away from the discharging exit 42*a* of the outlet passage 42*c* and close to the periphery of the conical closure while the impeller stays at rest. Thus, the skirt is responsive to the rotation of the impeller for opening wide apart from the slope surface 42*a* of the conical closure 42 and opening the discharging exit 42*b* of the outlet passage 42*c* (broken lines in FIG. 1). As may be realized, the state of the discharging exit being tightly encircled by the movable piece in place of being directly covered is called the "state of being closed" whereas the state of the movable piece being removed away from the discharging exit is called the "state of being opened".

The on-off valve may be made of an elastomer (rubber inclusive) and a resilient metal. Examples of the former material are EPDM, nitrile rubber, fluororubber and perfluoroelastomer whereas those of the latter are SUS alloys, titanium alloys and nickel alloys.

Figure 5:
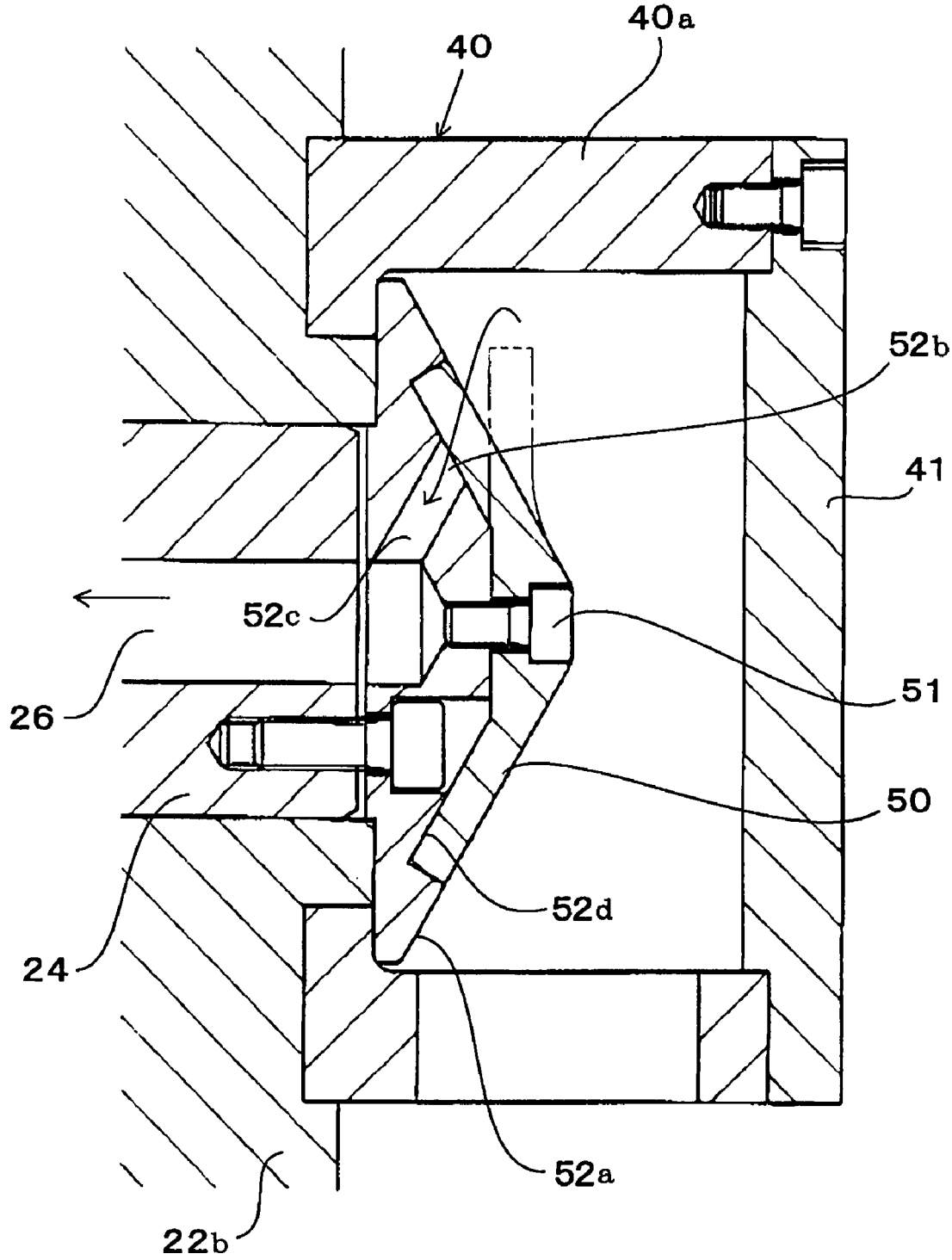
FIG. 5 is a longitudinal section of one modification of the discharging member and the on-off valve to be used in the medium agitation mill of FIG. 1.

Referring to FIG. 5, another example of on-off valve 50 is applied to the discharging exit 52 of the discharging member 52. Same parts as shown in FIG. 1 are indicated by same reference numerals as used in the drawing. The discharging member 52 is almost similar to the counter part 42 in FIG. 1, and is conical in shape.

The conical discharging member 52 has an outlet passage 52*c* made therein. Specifically, the outlet passage 52*c* opens at one end on the bottom of the conical closure, communicating with the longitudinal hollow space of the rotary drive shaft 24, and opening at the other end on the slope of the conical body. Thus, the slurry raw material separate from the pulverizing medium follows the outlet passage 52*c* and the raw material discharging channel 26*a* of the rotary drive shaft 24 to the exterior. Here, it should be noted that: the discharging member 52 is a part of the rotary drive shaft, and the outlet passage 52*c* is a part of the raw material discharging channel 26, and the discharging exit 52*b* corresponds to the entrance of the raw material discharging channel 26.

As seen from FIG. 5, the conical discharging member 52 has an umbrella-shaped recess made on its top, and an umbrella-shaped on-off valve 50 of a resilient material is fitted in the recess 52*d*. The on-off valve 50 is fastened by the top to the discharging member 52 with a screw 51, leaving its circumference freely movable. The on-off valve 50 is made of a similar material to the skirt-like on-off valve 45 in FIG. 1.

When the medium separating vane-wheel 40 (the medium agitating mill 10) is standstill, the on-off valve 50 is put in the closing position (solid lines in FIG. 5) whereas when the medium separating vane-wheel 40 (the medium agitating mill 10) is running, the on-off valve 50 is put in the opening position (broken lines in FIG. 5). When the impeller 40 stops, the on-off valve 50 automatically returns to the closing position under the resilient influence.

As described above, while the medium separating vane wheel 40 (the medium agitation mill 10) is running, the on-off valve 45 or 50 is put in the opening position, allowing the slurry raw material to enter the discharging channel 26 to the outside of the pulverizing tank 20. Specifically the medium separating impeller 40 is rotating to apply the centrifugal force to the pulverizing medium outward in radial directions all the time, thus keeping the pulverizing medium outward apart from the impeller 40, not allowing the pulverizing medium from coming close to the discharging exit 42*b* or 52*b*. Thus, the discharging of the pulverizing medium toward the exterior is completely prevented. When the medium separating vane wheel 40 (the medium agitation mill 10) stops, the on-off valve 45, 50 is put in the closing position to close the raw material discharging exit 42*b* or 52*b*. Thus, the discharging of the pulverizing medium toward the exterior is completely prevented.

Figure 6:
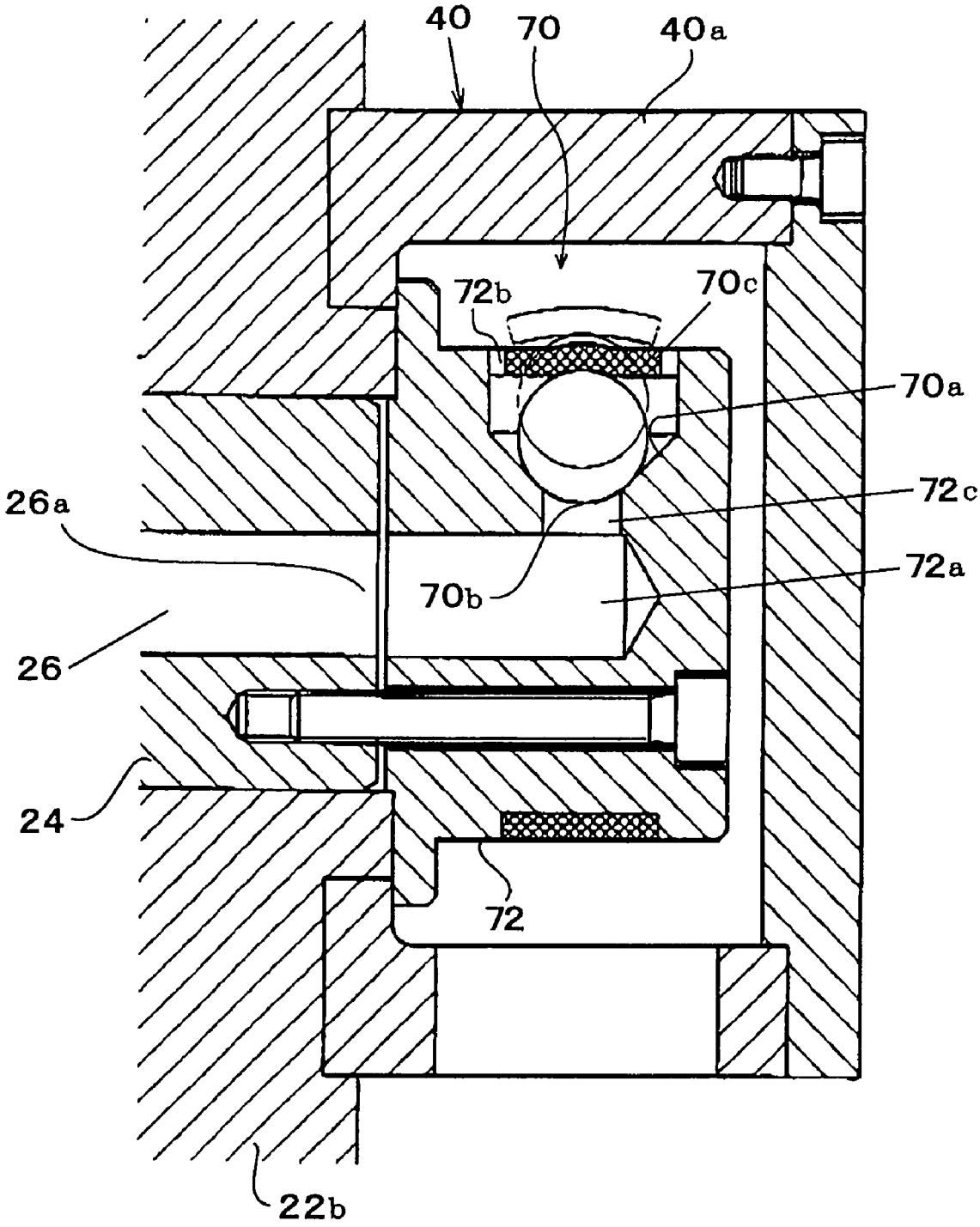
FIG. 6 is a longitudinal section of another modification of the discharging member and on-off valve to be used in the medium agitation mill of FIG. 1.

Referring to FIG. 6, still another example of on-off valve 70 is described below. The discharging member is indicated by the reference numeral 72. Same parts as shown in FIG. 1 are indicated by same reference numerals as used in the drawing.

The discharging member 72 is cylindrical in shape, and the cylindrical closure is fixedly set with its bottom confronting the rotary drive shaft 24 on the side of the entrance end of the raw material discharging channel 26. The cylindrical closure 72 has at least one discharging passage 72*c* formed in its side. The discharging passage 72*c* extends in radial direction, opening at one end in the cylindrical surface to define the discharging exit 72*b*, and opening at the other end to the hollow space of the cylindrical closure 72, thus forming a hollow extension 72*a* of predetermined length connecting the discharging exit 72*c* to the raw material discharging channel 26, which is provided by the longitudinal hollow space of the drive shaft 24. Thus, the pulverized material separate from the pulverizing medium follows the discharging exit 72*c*, the hollow extension 72*a* of the cylindrical closure and the discharging channel 26 of the drive shaft 24 to the exterior.

The on-off valve 70 is placed at the discharging exit 72*b*. It comprises a conical valve seat 70*a* formed in the hollow extension 72*a*, a valve body 70*b* movable between the closing position (solid lines in FIG. 6) where the valve body 70*b* rests on the valve seat 70*a* and the opening position (broken lines in FIG. 6) where the valve body 70*b* leaves the valve seat 70*a*, and a resilient member 70*c* to push the valve body 70*b* against the valve seat 70*a* while the vane wheel 40 stops. Preferably the raw material discharging exit 72*b* is somewhat larger than the width of the valve body 70*c*, leaving the gap to permit the slurry raw material to pass through. The resilient member 70*c* is made of rubber, and it is like for example, a rubber band, encircling the cylindrical circumference of the cylindrical closure 72. When the vane wheel 40 rotates, the valve body 70*b* moves outward in radial direction under the centrifugal influence, overcoming the resilient force of the resilient member 70*c* and reaching the opening position and remaining there.

As mentioned above, while the medium separating vane wheel 40 (the medium agitation mill 10) stops, the valve body 70*b* is put in the closing position (solid lines in FIG. 6), thus closing the discharging passage 72*c*. While the medium separating vane wheel 40 (the medium agitation mill 10) is running, the valve body 70*b* is put in the opening position (broken lines in FIG. 6), thus opening the discharging passage 72*c*. When the medium separating vane wheel 40 (the medium agitation mill 10) stops, the centrifugal influence is lost, thus allowing the valve body 70*b* to automatically move to the closing position under the resilient influence.

Figure 7:
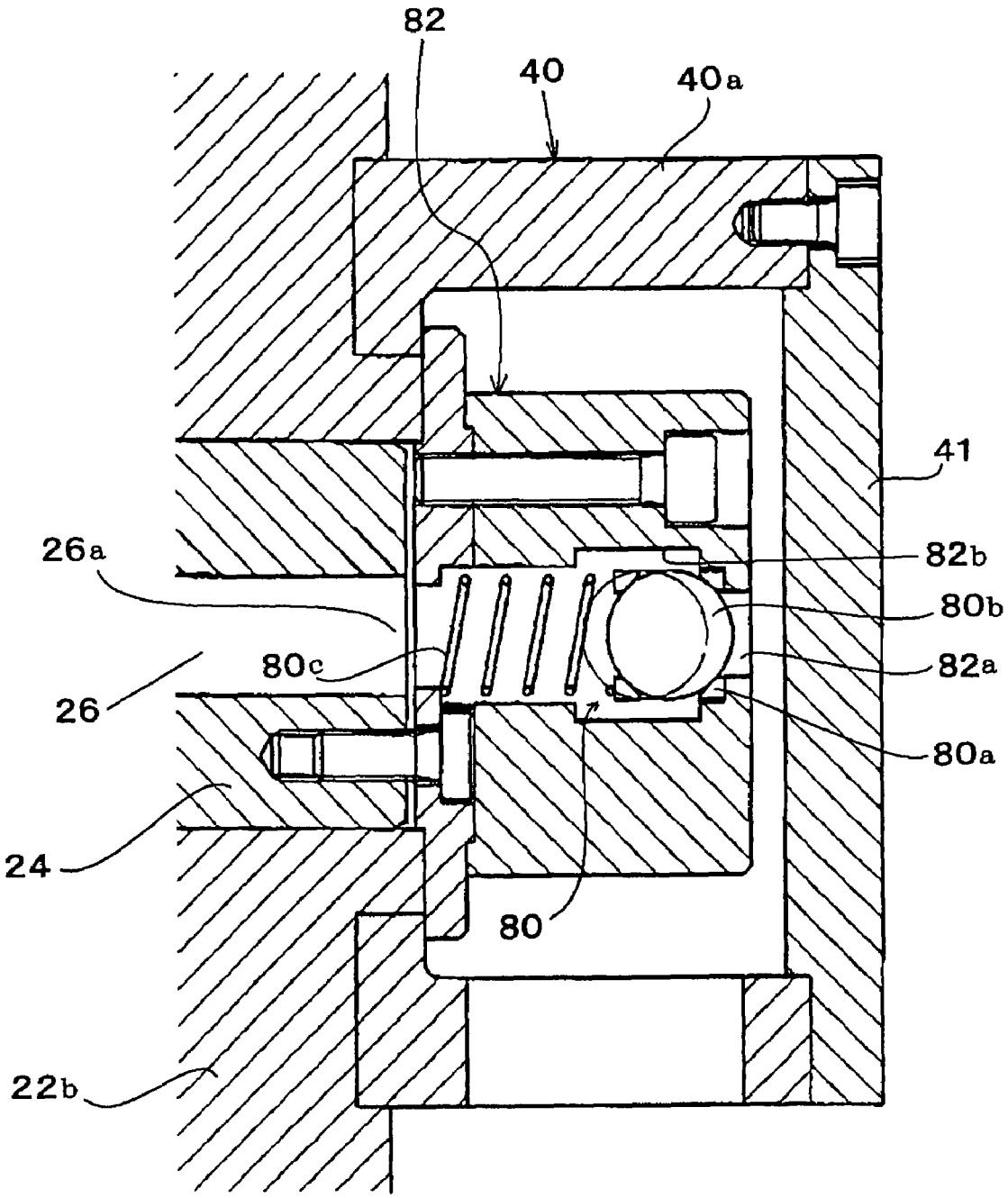
FIG. 7 is a longitudinal section of still another modification of the discharging member and on-off valve to be used in the medium agitation mill of FIG. 1.

Referring to FIG. 7, yet still another example of on-off valve 80 is described below. The discharging member is indicated by the reference numeral 82. Same other parts as shown in FIG. 1 are indicated by same reference numerals as used in the drawing.

The discharging member 82 is cylindrical in shape, and the cylindrical closure is fixedly set with its bottom confronting the rotary drive shaft 24 on the side of the entrance end of the raw material discharging channel 26. The cylindrical closure 82 has one discharging passage 82*b* formed therein. Specifically the discharging passage 82*b* extends in axial direction, opening at one end in the ceiling surface to define the discharging exit 82*a*, and opening at the other end to the hollow space of the cylindrical closure 82, thus communicating with the raw material discharging channel 26, which is provided by the longitudinal hollow space of the drive shaft 24. Thus, the pulverized material separate from the pulverizing medium follows the discharging passage 82*b* of the cylindrical closure 82 and the discharging channel 26 of the drive shaft 24 to the exterior.

The on-off valve 80 is placed in the discharging passage 82*b*. It comprises a step-like valve seat 80*a* formed in the discharging passage 82*b*, a valve body 80*b* movable between the closing position (solid lines in FIG. 7) where the valve body 80*b* rests on the valve seat 80*a* and the opening position (broken lines in FIG. 7) where the valve body 80*b* leaves the valve seat 80*a*, and a coiled spring 80*c* functioning as a resilient member to push the valve body 80*b* against the valve seat 80*a* while the medium agitation mill 10 stops. When the medium agitation mill 10 is running, the pressure of the raw material (slurry) increases to overcome the resilient force of the coiled spring 80*c*, thus putting the valve body 80*b* in the opening position. When the medium agitation mill 10 stops, the pressure of the raw material (slurry) lowers to allow the coiled spring 80*c* to expand and return to the closing position under the resilient influence.

In the above described embodiments the agitating member is integrally connected with the medium separating vane wheel, but the agitating member can be separated from the vane wheel. Then, the agitating member and the vane wheel can be driven independently, and therefore, they can be controlled independently. Thus, the vane wheel can be controlled in speed of revolution so as to best attain the classification in granularity. Typically, the speed of revolution of the agitating member ranges from 4 to 15 m/s, and usually the speed of revolution ranges from 10 to 12 m/s. Typically, the speed of revolution of the impeller ranges from 4 to 20 m/s, and usually the speed of revolution of 10 m/s provides the satisfactory result.

Figure 8:
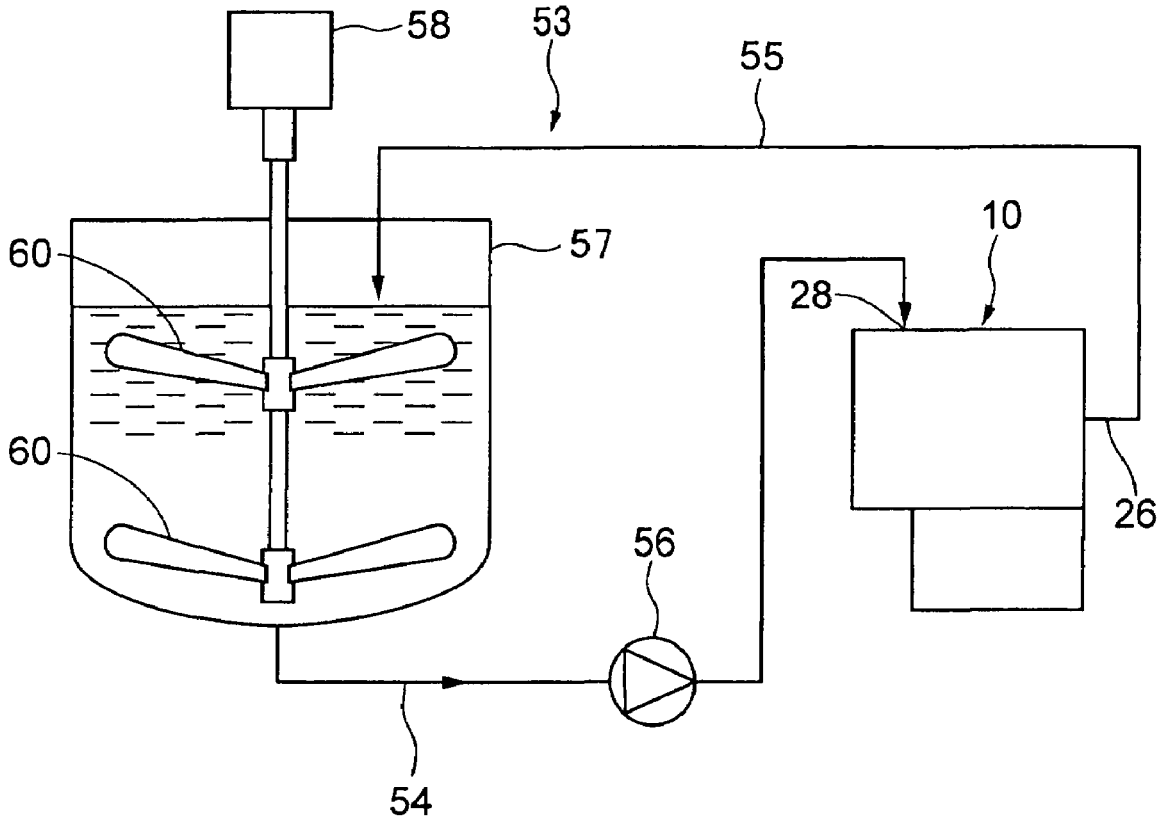
FIG. 8 diagrammatically shows how a circulating type of medium agitation mill is used.

FIG. 8 diagrammatically shows how a medium agitation mill 10 according to the present invention is used in gradually crushing or grinding the slurry raw material while circulating in a closed loop. Specifically the raw material is driven from the raw material feeding port 28 to the raw material discharging port 26 through the medium agitation mill 10 and the circulating loop 53 while the "to be pulverized" substance is reduced less and less in granularity and distributed evenly more and more every time the raw material has passed through the medium agitation mill. The circulation loop 53 includes a conduit 55, one end of which is connected to the medium agitation mill 10, and the other end of which conduit opens to the top of a slurry tank 57. Another conduit 54 connects the bottom of the slurry tank 57 to the raw material feeding port 28 via a pump 56. The slurry tank 57 has an agitating vane assembly 60 immersed therein, which is rotated by an associated electric motor 58. With this arrangement the slurry is made to repeatedly flow through the medium agitation mill 10 until the ultrafine granularity is obtained.

In operation the slurry raw material containing the "to be pulverized" substance in the form of particles is fed to the medium agitation mill 10 via the feeding port 28 while the agitating member 22 is rotated. Then, the on-off valves 45, 50, 70 and 80 are open. The slurry flowing into the pulverizing compartment C1 are mixed with the pulverizing medium 30, and the mixture is agitated and rotated in the pulverizing compartment C1. Rotation of the pulverizing medium causes the crushing of the minute particles in the slurry, and the so crushed particles are distributed in the slurry. Then, the slurry along with the pulverizing medium enter the inside space of the agitating member, that is, the medium separating compartment C2, in which the slurry and the pulverizing medium are rotated by the impeller 40 so that the pulverizing medium of a relatively large specific gravity is driven outward in radial directions to return to the pulverizing compartment C1 through the circulating apertures 22*d* and 22*e*. The "to be pulverized" particles whose particle size remains relatively large due to insufficient crushing behave in the same way as the pulverizing medium. On the other hand, the "to be pulverized" particles whose particle size is relatively small due to sufficient crushing enter the inside space of the impeller, and such pulverized particles are discharged from the raw material discharging port. With this arrangement the required pulverization can be attained with the granularity remaining in a narrow range. When the medium agitation mill stops, the on-off valves 45, 50, 70 and 80 automatically close the raw material discharging port 42*b*, 52*b* or discharging passages 62*c* and 82*b*, thus preventing the discharging of the pulverizing medium to the exterior.

What is claimed is:

1. A medium agitation mill in which an agitating member is rotatably fixed in a cylindrical pulverizing tank with an inlet provided for a raw material bearing a substance to be pulverized, the pulverizing tank having a pulverizing compartment with a pulverizing medium contained therein, thus rotating the agitating member while being supplied with the raw material via the inlet and agitating the pulverizing medium to crush or grind the substance into ultrafine particles, characterized in that:

the agitating member comprises a hollow, bottomless cylinder having a cylindrical wall on its circumference, the cylindrical wall having apertures circumferentially made at intervals for circulating the pulverizing medium;

the agitating member has a medium-separating vane wheel arranged coaxial with the agitating member and fixed in its inner space and, the medium-separating vane wheel having a plurality of vanes arranged on its circumference and fixed at intervals; and a hollow drive shaft has an outlet at its end, opening to the inside of the medium-separating vane wheel, and is adapted to drive and rotate the vane wheel so as to make the relatively heavy medium fly away from the relatively light "to be pulverized" substance in radial directions under the centrifugal influence, allowing the crushed substance separate from the medium to flow into the outlet, which has an on-off valve responsive to the standstill of the vane wheel for closing the outlet and responsive to the rotating of the vane wheel for opening the outlet under the centrifugal influence.

2. A medium agitation mill according to claim 1 wherein the on-off valve is of a resilient material of elastomer.

3. A medium agitation mill according to claim 2 wherein the plurality of vanes of the media-separating vane wheel are fixed to an end plate, which confronts the outlet of the hollow drive shaft for the raw material, the hollow drive shaft having a conical closure fixed to its end with the flat base of the conical closure resting on the raw material outlet, the conical closure having an outlet passage formed and opening at one end on the bottom of the conical closure whereas opening at the other end on the slope surface of the conical closure to communicate with the longitudinal hollow space of the drive shaft, thus permitting the pulverized material separate from the medium to follow the outlet passage and the longitudinal hollow space to the exterior, the on-off valve being a skirt-like object hanging from the end plate of the vane wheel with its leading end put in contact with the slope surface of the conical closure in such a position the leading end is away from the entrance of the outlet passage and close to the periphery of the conical closure while the vane wheel stays at rest, thus making the skirt responsive to the rotation of the vane wheel for opening wide apart from the slope surface of the conical closure and opening the entrance of the outlet passage.

4. A medium agitation mill according to claim 2 wherein the hollow drive shaft has a conical closure fixed to its end with the flat base of the conical closure resting on the raw material outlet of the drive shaft, the conical closure having an outlet passage formed therein and opening at one end on the bottom of the conical closure whereas opening at the other end on the slope surface of the conical closure to communicate with the longitudinal hollow space of the drive shaft, thus permitting the pulverized material separate from the medium to follow the outlet passage and the longitudinal hollow space to the exterior, the on-off valve being a plate traversing the entrance of the outlet passage, the plate being pivotally fixed by the upper end, thereby permitting its free end to rotate about the pivot between the closing position to close the entrance of the outlet passage and the opening position to open the entrance of the outlet passage while the plate is raised apart from the slope surface of the conical closure.

5. A medium agitation mill according to claim 2 wherein the hollow drive shaft has a cylindrical closure fixed to its end with the bottom of the cylindrical closure confronting the end of the outlet channel of the drive shaft, the cylindrical closure having at least one outlet passage formed in its side and opening to the hollow space of the cylindrical closure, thus forming a hollow extension connecting to the longitudinal hollow space of the drive shaft and permitting the pulverized material separate from the medium to follow the hollow extension of the cylindrical closure and the longitudinal hollow space of the drive shaft to the exterior, the on-off valve comprising a valve seat formed in the hollow extension, a valve body movable between the closing position where the valve body rests on the valve seat and the opening position where the valve body leaves the valve seat, and a resilient member to push the valve body against the valve seat while the vane wheel stops and yieldingly deform and allow the valve body to shift to the opening position under the centrifugal influence while the vane wheel rotates.

6. A medium agitation mill according to claim 2 wherein the hollow drive shaft has a cylindrical closure fixed to its end with the bottom of the cylindrical closure confronting the end of the outlet channel of the drive shaft, the cylindrical closure having an outlet passage formed in its bottom and opening to the hollow space of the cylindrical closure, thus forming a hollow extension connecting to the longitudinal hollow space of the drive shaft and permitting the pulverized material separate from the medium to follow the hollow extension of the cylindrical closure and the longitudinal hollow space of the drive shaft to the exterior; the on-off valve comprising a valve seat formed in the hollow extension, a valve body movable between the closing position where the valve body rests on the valve seat and the opening position where the valve body leaves the valve seat, and a resilient member to push the valve body against the valve seat into the closing position while the vane wheel stops and yieldingly withdraw and permit the valve body to move to the opening position under the increased pressure from the raw material while the vane wheel rotates.

7. A medium agitation mill according to claim 1 wherein the on-off valve is of a resilient material of metal.

8. A medium agitation mill according to claim 7 wherein the plurality of vanes of the media-separating vane wheel are fixed to an end plate, which confronts the outlet of the hollow drive shaft for the raw material, the hollow drive shaft having a conical closure fixed to its end with the flat base of the conical closure resting on the raw material outlet, the conical closure having an outlet passage formed and opening at one end on the bottom of the conical closure whereas opening at the other end on the slope surface of the conical closure to communicate with the longitudinal hollow space of the drive shaft, thus permitting the pulverized material separate from the medium to follow the outlet passage and the longitudinal hollow space to the exterior, the on-off valve being a skirt-like object hanging from the end plate of the vane wheel with its leading end put in contact with the slope surface of the conical closure in such a position the leading end is away from the entrance of the outlet passage and close to the periphery of the conical closure while the vane wheel stays at rest, thus making the skirt responsive to the rotation of the vane wheel for opening wide apart from the slope surface of the conical closure and opening the entrance of the outlet passage.

9. A medium agitation mill according to claim 7 wherein the hollow drive shaft has a conical closure fixed to its end with the flat base of the conical closure resting on the raw material outlet of the drive shaft, the conical closure having an outlet passage formed therein and opening at one end on the bottom of the conical closure whereas opening at the other end on the slope surface of the conical closure to communicate with the longitudinal hollow space of the drive shaft, thus permitting the pulverized material separate from the medium to follow the outlet passage and the longitudinal hollow space to the exterior, the on-off valve being a plate traversing the entrance of the outlet passage, the plate being pivotally fixed by the upper end, thereby permitting its free end to rotate about the pivot between the closing position to close the entrance of the outlet passage and the opening position to open the entrance of the outlet passage while the plate is raised apart from the slope surface of the conical closure.

10. A medium agitation mill according to claim 7 wherein the hollow drive shaft has a cylindrical closure fixed to its end with the bottom of the cylindrical closure confronting the end of the outlet channel of the drive shaft, the cylindrical closure having at least one outlet passage formed in its side and opening to the hollow space of the cylindrical closure, thus forming a hollow extension connecting to the longitudinal hollow space of the drive shaft and permitting the pulverized material separate from the medium to follow the hollow extension of the cylindrical closure and the longitudinal hollow space of the drive shaft to the exterior, the on-off valve comprising a valve seat formed in the hollow extension, a valve body movable between the closing position where the valve body rests on the valve seat and the opening position where the valve body leaves the valve seat, and a resilient member to push the valve body against the valve seat while the vane wheel stops and yieldingly deform and allow the valve body to shift to the opening position under the centrifugal influence while the vane wheel rotates.

11. A medium agitation mill according to claim 7 wherein the hollow drive shaft has a cylindrical closure fixed to its end with the bottom of the cylindrical closure confronting the end of the outlet channel of the drive shaft, the cylindrical closure having an outlet passage formed in its bottom and opening to the hollow space of the cylindrical closure, thus forming a hollow extension connecting to the longitudinal hollow space of the drive shaft and permitting the pulverized material separate from the medium to follow the hollow extension of the cylindrical closure and the longitudinal hollow space of the drive shaft to the exterior; the on-off valve comprising a valve seat formed in the hollow extension, a valve body movable between the closing position where the valve body rests on the valve seat and the opening position where the valve body leaves the valve seat, and a resilient member to push the valve body against the valve seat into the closing position while the vane wheel stops and yieldingly withdraw and permit the valve body to move to the opening position under the increased pressure from the raw material while the vane wheel rotates.

12. A medium agitation mill according to claim 1 wherein the plurality of vanes of the media-separating vane wheel are fixed to an end plate, which confronts the outlet of the hollow drive shaft for the raw material, the hollow drive shaft having a conical closure fixed to its end with the flat base of the conical closure resting on the raw material outlet, the conical closure having an outlet passage formed and opening at one end on the bottom of the conical closure whereas opening at the other end on the slope surface of the conical closure to communicate with the longitudinal hollow space of the drive shaft, thus permitting the pulverized material separate from the medium to follow the outlet passage and the longitudinal hollow space to the exterior, the on-off valve being a skirt-like object hanging from the end plate of the vane wheel with its leading end put in contact with the slope surface of the conical closure in such a position the leading end is away from the entrance of the outlet passage and close to the periphery of the conical closure while the vane wheel stays at rest, thus making the skirt responsive to the rotation of the vane wheel for opening wide apart from the slope surface of the conical closure and opening the entrance of the outlet passage.

13. A medium agitation mill according to claim 1 wherein the hollow drive shaft has a conical closure fixed to its end with the flat base of the conical closure resting on the raw material outlet of the drive shaft, the conical closure having an outlet passage formed therein and opening at one end on the bottom of the conical closure whereas opening at the other end on the slope surface of the conical closure to communicate with the longitudinal hollow space of the drive shaft, thus permitting the pulverized material separate from the medium to follow the outlet passage and the longitudinal hollow space to the exterior, the on-off valve being a plate traversing the entrance of the outlet passage, the plate being pivotally fixed by the upper end, thereby permitting its free end to rotate about the pivot between the closing position to close the entrance of the outlet passage and the opening position to open the entrance of the outlet passage while the plate is raised apart from the slope surface of the conical closure.

14. A medium agitation mill according to claim 1 wherein the hollow drive shaft has a cylindrical closure fixed to its end with the bottom of the cylindrical closure confronting the end of the outlet channel of the drive shaft, the cylindrical closure having at least one outlet passage formed in its side and opening to the hollow space of the cylindrical closure, thus forming a hollow extension connecting to the longitudinal hollow space of the drive shaft and permitting the pulverized material separate from the medium to follow the hollow extension of the cylindrical closure and the longitudinal hollow space of the drive shaft to the exterior, the on-off valve comprising a valve seat formed in the hollow extension, a valve body movable between the closing position where the valve body rests on the valve seat and the opening position where the valve body leaves the valve seat, and a resilient member to push the valve body against the valve seat while the vane wheel stops and yieldingly deform and allow the valve body to shift to the opening position under the centrifugal influence while the vane wheel rotates.

15. A medium agitation mill according to claim 1 wherein the hollow drive shaft has a cylindrical closure fixed to its end with the bottom of the cylindrical closure confronting the end of the outlet channel of the drive shaft, the cylindrical closure having an outlet passage formed in its bottom and opening to the hollow space of the cylindrical closure, thus forming a hollow extension connecting to the longitudinal hollow space of the drive shaft and permitting the pulverized material separate from the medium to follow the hollow extension of the cylindrical closure and the longitudinal hollow space of the drive shaft to the exterior; the on-off valve comprising a valve seat formed in the hollow extension, a valve body movable between the closing position where the valve body rests on the valve seat and the opening position where the valve body leaves the valve seat, and a resilient member to push the valve body against the valve seat into the closing position while the vane wheel stops and yieldingly withdraw and permit the valve body to move to the opening position under the increased pressure from the raw material while the vane wheel rotates.

* * * * *